US009764560B2

(12) United States Patent
Yokota et al.

(10) Patent No.: US 9,764,560 B2
(45) Date of Patent: Sep. 19, 2017

(54) LIQUID EJECTING APPARATUS AND TRANSPORT AMOUNT ADJUSTING METHOD

(71) Applicant: SEIKO EPSON CORPORATION, Tokyo (JP)

(72) Inventors: So Yokota, Shiojiri (JP); Hiroya Hochi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/259,455

(22) Filed: Sep. 8, 2016

(65) Prior Publication Data

US 2017/0072715 A1 Mar. 16, 2017

(30) Foreign Application Priority Data

Sep. 11, 2015 (JP) ..... 2015-179677

(51) Int. Cl.
*B41J 2/045* (2006.01)
*B41J 2/21* (2006.01)
*B41J 29/393* (2006.01)

(52) U.S. Cl.
CPC ..... *B41J 2/2135* (2013.01); *B41J 2/2132* (2013.01); *B41J 2029/3935* (2013.01)

(58) Field of Classification Search
CPC .. B41J 2/04505; B41J 2/04586; B41J 2/2135; B41J 2/2145; B41J 9/145; B41J 13/0009
See application file for complete search history.

(56) References Cited

U.S. PATENT DOCUMENTS

2006/0197785 A1* 9/2006 Uchida ..... B41J 11/425 347/5
2008/0252675 A1 10/2008 Yasutani et al.
2016/0089883 A1 3/2016 Yokota
2016/0089918 A1 3/2016 Yokota

FOREIGN PATENT DOCUMENTS

JP 11-020248 A 1/1999
JP 2008-260171 A 10/2008
JP 2011-131499 A 7/2011
JP 2015-178202 A 10/2015
JP 2016-064620 A 4/2016
JP 2016-064622 A 4/2016
JP 2016-068435 A 5/2016

* cited by examiner

*Primary Examiner* — Thinh H Nguyen
(74) *Attorney, Agent, or Firm* — Foley & Lardner LLP

(57) ABSTRACT

A liquid ejecting apparatus includes an ejecting unit that includes a nozzle column configured to eject liquid, the ejecting unit being configured to reciprocate along a first direction that intersects the nozzle column; a transport unit configured to transport a medium in a second direction that intersects the first direction; and a control unit configured to control the ejecting unit and the transport unit such that first and second patterns are formed. The first and second patterns are formed such that a plurality of boundaries between the first pattern and the second pattern are formed in between boundary portions of the first pattern and boundary portions of the second pattern.

9 Claims, 7 Drawing Sheets

LIQUID EJECTING APPARATUS AND TRANSPORT AMOUNT ADJUSTING METHOD

CROSS-REFERENCE TO RELATED APPLICATION

The present application claims priority to Japanese Patent Application No. 2015-179677, filed on Sep. 11, 2015, the contents of which are hereby incorporated by reference in their entirety.

BACKGROUND

1. Technical Field

The present disclosure relates to a liquid ejecting apparatus, and a transport amount adjusting method.

2. Related Art

In the related art, a liquid ejecting apparatus such as a recording apparatus which ejects liquid such as ink onto a medium such as a medium for recording, which is transported, has been used. In general, in such a liquid ejecting apparatus, a transport amount of the medium is adjusted before ejecting liquid onto the medium.

For example, JP-A-11-20248 discloses a printer (liquid ejecting apparatus) in which an adjusting pattern is recorded, and a transport amount of a medium can be adjusted, based on a position, or the number of moire (striped pattern, or stripe-shaped interference fringe which visually occurs when plurality of patterns which are regularly repeated are overlapped, due to shift in cycle thereof) which appears in the adjusting pattern.

In a liquid ejecting apparatus in JP-A-11-20248, an adjusting pattern is formed when liquid is ejected from a plurality of nozzles, and a transport amount of a medium is adjusted based on a landing position of liquid which is ejected from a specific nozzle among the plurality of nozzles. That is, accuracy in an ejecting direction of liquid that is ejected from the specific nozzle is important when adjusting a transport amount of a medium.

However, when an ejecting failure occurs (liquid is not ejected in desired ejecting direction) due to attachment of foreign substances to the specific nozzle, or the like, liquid lands on a position shifted from a desired landing position, and it is not possible to accurately adjust a transport amount of a medium.

SUMMARY

An advantage of some embodiments of the invention is that inaccurate adjustment of a transport amount of a medium is prevented, even in a case in which there is an ejecting failure in an ejecting unit.

According to an aspect of the invention, there is provided a liquid ejecting apparatus which includes an ejecting unit which includes a nozzle column which ejects liquid, and can reciprocate in a first direction which intersects the nozzle column; a transport unit which transports a medium in a second direction which intersects the first direction; and a control unit which performs a control so that a first pattern including a boundary region in which a plurality of boundary portions of an ejecting region and a non-ejecting region of the liquid are formed in the second direction is formed on the medium, by causing the liquid to be ejected from the ejecting unit, the medium on which the first pattern is formed is transported by the transport unit, and a second pattern including a boundary region in which a plurality of the boundary portions are provided corresponding to the boundary region of the first pattern in the second direction is formed on the medium, by causing the liquid to be ejected from the ejecting unit, in which a plurality of boundaries between the first pattern and the second pattern which are formed by the boundary portions of the first pattern and the second pattern which are formed by the boundary region of the first pattern and the boundary region of the second pattern are formed in the second direction.

According to this aspect, a medium is transported after forming the first pattern, and the second pattern is formed after transporting the medium, and thus, it is possible to recognize a transport amount using a boundary between the first pattern and the second pattern. In addition, since the transport amount of a medium is adjusted by forming a plurality of the boundaries, even when there is an ejecting failure in a nozzle which forms one boundary, it is possible to accurately adjust a transport amount of the medium, if there is no ejecting failure in a nozzle which forms another boundary. For this reason, it is possible to prevent inaccurate adjustment of a transport amount of a medium, even in a case in which there is an ejecting failure in an ejecting unit.

In the liquid ejecting apparatus according to a second aspect of the invention, at least one of the first pattern and the second pattern may include a comparison pattern which can be compared with the boundary.

According to this aspect, at least one of the first pattern and the second pattern includes the comparison pattern which can be compared with the boundary. For this reason, it is possible to simply recognize an appropriate transport amount by referring to the comparison pattern, and accurately perform adjustment of the transport amount, simply.

Here, "can be compared with boundary" also means that it is possible to be compared with a portion in which a boundary is formed.

In the liquid ejecting apparatus according to a third aspect of the invention, the control unit may perform a control so that the first pattern and the second pattern are formed on the medium along with a movement of the ejecting unit in outward directions or return directions in the first direction.

In general, there is a case in which spreading of a landing position of liquid in a direction along a nozzle column becomes different in a case in which liquid is ejected from the nozzle column by causing the ejecting unit to move in the outward direction, than in a case in which liquid is ejected from the nozzle column by causing the ejecting unit to move in the return direction. Accordingly, it is possible to accurately perform adjustment of a transport amount when forming the first pattern and the second pattern along with a movement of the ejecting unit in the outward directions or the return directions, rather than forming the first pattern and the second pattern using combined movements of the ejecting unit in the outward direction and the return direction. According to this aspect, the first pattern and the second pattern are formed along with a movement of the ejecting unit in the outward directions or the return directions. For this reason, particularly, it is possible to accurately perform adjustment of a transport amount.

In the liquid ejecting apparatus according to a fourth aspect of the invention, the control unit may receive forming information of the boundary, and may adjust a transport amount of the medium using the transport unit, based on the forming information.

According to this aspect, the control unit receives the forming information of the boundary, and adjusts the transport amount of the medium using the transport unit based on the forming information. For this reason, it is possible to perform adjustment of a transport amount accurately, using a simple method of inputting the forming information of the boundary to the control unit.

Here, as "forming information of boundary", there is, for example, information related to whether or not moire occurs in a portion in which a boundary is formed, or the like. In addition, "receiving forming information of boundary" means that, for example, a user determines a desired transport amount from a forming state of a boundary, inputs the desired transport amount using a user interface, or the like, and receives input contents thereof. Alternatively, it means that a sensor, or the like, which reads a boundary is provided in the liquid ejecting apparatus, and data which is read using the sensor is received; however, it is not particularly limited to this.

In the liquid ejecting apparatus according to a fifth aspect of the invention, the control unit may perform a control so that the first pattern and the second pattern are formed on the medium along with a movement of the ejecting unit in the outward directions and the return directions in the first direction, may receive forming information of the respective boundaries which are formed on the medium along with a movement of the ejecting unit in the outward directions and the return directions, and may adjust a transport amount of the medium using the transport unit based on each of the forming information.

According to this aspect, the control unit performs a control so that the first pattern and the second pattern are formed on the medium along with a movement of the ejecting unit in the outward directions and the return directions, receives the forming information of the respective boundaries which are formed in the medium along with a movement of the ejecting unit in the outward directions and the return directions, and adjusts a transport amount based on each of the forming information. That is, adjusting patterns of the transport amount which is formed of the first pattern and the second pattern are formed along with a movement of the ejecting unit in the outward directions and a movement of the ejecting unit in the return directions, and transport amounts are adjusted based on each forming information of these adjusting patterns. For this reason, particularly, it is possible to accurately perform adjustment of the transport amount.

Here, "based on each forming information" means that, for example, an average of forming information of an adjusting pattern which is formed along with a movement of the ejecting unit in the outward directions, and forming information of an adjusting pattern which is formed along with a movement of the ejecting unit in the return directions is calculated, or the like; however, it is not particularly limited to this. Weighting may be performed with respect to each forming information of both of the adjusting patterns according to conditions for causing liquid to be ejected (for example, frequency of ejecting liquid while moving ejecting unit in outward direction, and frequency of ejecting liquid while moving ejecting unit in return direction are different, or the like).

In the liquid ejecting apparatus according to a sixth aspect, the transport unit may include a transport roller, and the control unit may perform a control so that the first pattern and the second pattern are formed on the medium n times, while setting a transport amount of the medium between forming of the first pattern and forming of the second pattern to a transport amount corresponding to a rotation amount of 1/n (n is integer) of the transport roller.

According to this aspect, the first pattern and the second pattern are formed on the medium n times, while setting a transport amount of the medium between forming of the first pattern and forming of the second pattern to a transport amount corresponding to a rotation amount of 1/n (n is integer) of the transport roller. That is, an adjusting pattern of a transport amount corresponding to one circle of the transport roller is formed. For this reason, in a case in which the transport roller is in an eccentric state, for example, it is possible to perform adjustment of a transport amount while suppressing an influence of the eccentric state.

Here, "rotation amount of 1/n of transport roller" means that it may be a rotation amount of 1/n of the transport roller, roughly, and it is not necessary to be a rotation amount of 1/n of the transport roller in a strict sense.

In the liquid ejecting apparatus according to a seventh aspect of the invention, the ejecting region and the non-ejecting region may be alternately formed in the second direction in the boundary region of the first pattern, and in the boundary region of the second pattern, the non-ejecting region may be formed corresponding to the ejecting region of the boundary region of the first pattern, and the ejecting region may be formed corresponding to the non-ejecting region of the boundary region of the first pattern.

According to this aspect, in a case in which a user can easily make a propriety determination, visually, and there is an ejecting failure in the ejecting unit, it is possible to simply configure a pattern which prevents inaccurate adjustment of a transport amount of a medium.

According to another aspect of the invention, there is provided a transport amount adjusting method which is executed using a liquid ejecting apparatus including an ejecting unit which includes a nozzle column ejecting liquid, and can reciprocate in a first direction which intersects the nozzle column; and a transport unit which transports a medium in a second direction which intersects the first direction, the method including forming a first pattern including a boundary region in which a plurality of boundary portions of an ejecting region and a non-ejecting region of liquid are formed in the second direction on the medium, by causing the liquid to be ejected from the ejecting unit; transporting the medium on which the first pattern is formed to the transport unit; and forming a second pattern including a boundary region in which a plurality of the boundary portions are provided corresponding to the boundary region of the first pattern in the second direction on the medium, by causing the liquid to be ejected from the ejecting unit, in which a plurality of boundaries of the first pattern and the second pattern which are formed by the boundary portions of the first pattern and the second pattern which are formed by the boundary region of the first pattern and the boundary region of the second pattern are formed in the second direction.

According to this aspect, a medium is transported after forming the first pattern, the second pattern is formed after transporting the medium, and it is possible to recognize a transport amount using a boundary between the first pattern and the second pattern. In addition, since a transport amount of a medium is adjusted by forming a plurality of the boundaries, even when there is an ejecting failure in a nozzle which forms one boundary, it is possible to accurately adjust a transport amount of the medium, if there is no ejecting failure in a nozzle which forms another boundary. For this reason, it is possible to prevent inaccurate adjustment of a transport amount of the medium, even in a case in which there is an ejecting failure in the ejecting unit.

BRIEF DESCRIPTION OF THE DRAWINGS

Embodiments of the invention will be described with reference to the accompanying drawings, wherein like numbers reference like elements.

DETAILED DESCRIPTION

Hereinafter, a recording apparatus as a liquid ejecting apparatus according to an embodiment of the invention will be described in detail with reference to the accompanying drawings.

First, a summary of the recording apparatus according to an exemplary embodiment will be provided.

Figure 1:
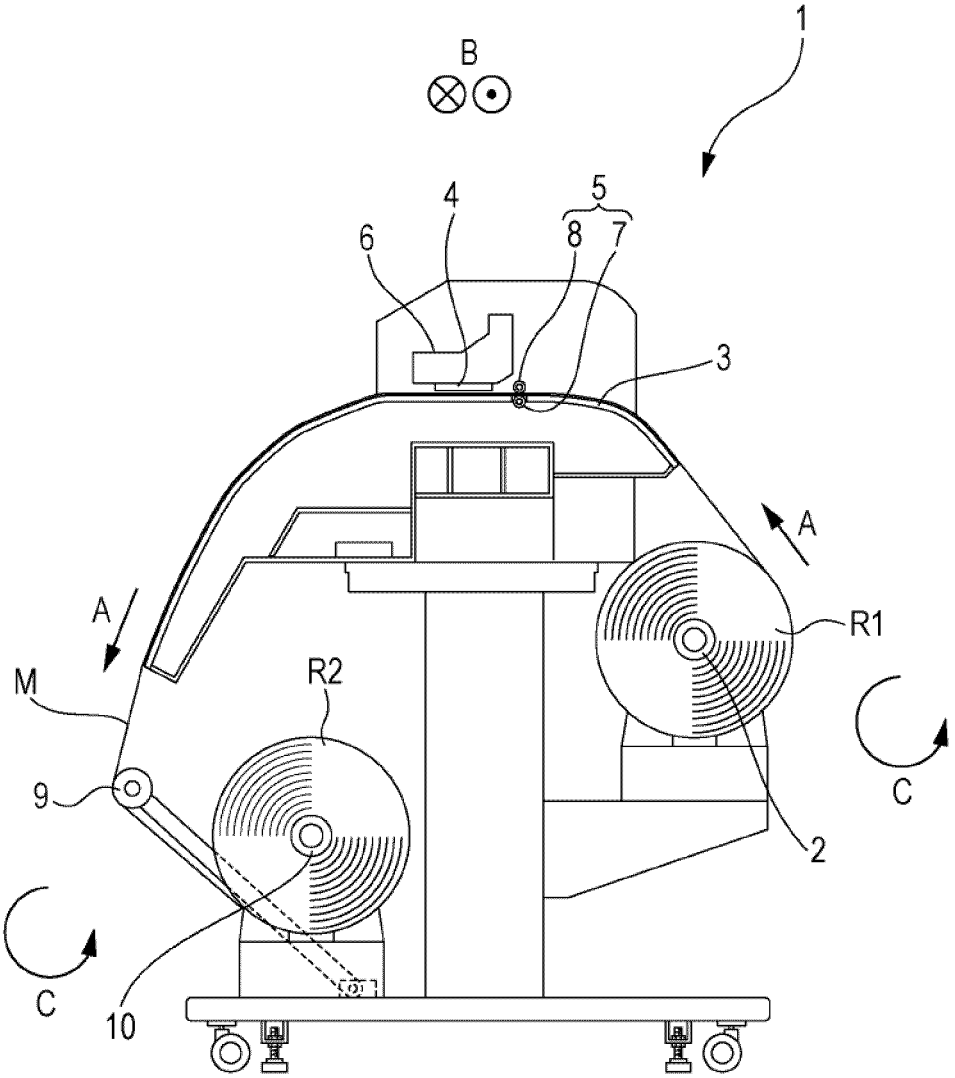
FIG. 1 is a schematic side view which illustrates a recording apparatus according to an embodiment of the invention.

FIG. 1 is a schematic side view of a recording apparatus 1 according to the embodiment.

The recording apparatus 1 according to the embodiment is provided with a supporting shaft 2 which supports a roll R1 of a medium for recording (medium) M in a roll shape for performing recording. In addition, in the recording apparatus 1 according to the embodiment, the supporting shaft 2 rotates in a rotation direction C when the medium for recording M is transported in a transport direction A. According to the embodiment, a roll-type medium for recording M of which a face for recording is wound so as to be the outer side is used; however, in a case in which a roll-type medium for recording M of which a face for recording is wound so as to be the inner side is used, it is possible to send out the roll R1 by performing a rotation reverse to the rotation direction C of the supporting shaft 2.

The recording apparatus 1 according to the embodiment uses a roll-type medium for recording as the medium for recording M; however, it is not limited to the recording apparatus which uses such a roll-type medium for recording. For example, a medium for recording of a cutform type may be used.

The recording apparatus 1 according to the embodiment is provided with a pair of transport rollers 5 which is formed of a driving roller 7 (transport roller) and a driven roller 8, for transporting the medium for recording M in the transport direction A on a transport path of the medium for recording M which is formed of a medium support unit 3, or the like, as a transport unit.

In the recording apparatus 1 according to the embodiment, the driving roller 7 is configured of one roller which extends in a direction B which intersects the transport direction A of the medium for recording M, and a plurality of the driven rollers 8 are aligned in the direction B at a position facing the driving roller 7.

A heater (not illustrated) which can heat the medium for recording M supported by the medium support unit 3 is provided below the medium support unit 3. In this manner, the recording apparatus 1 according to the embodiment is provided with the heater which can heat the medium for recording M from the medium support unit 3 side, and may be provided with an infrared heater which is provided at a position facing the medium support unit 3.

The recording apparatus 1 according to the embodiment is further provided with a recording head 4 as an ejecting unit which ejects ink from nozzles on a nozzle forming face on which a plurality of the nozzles are formed, and performs recording, and a carriage 6 which can reciprocate in the direction B, by being mounted with the recording head 4 thereon.

A winding shaft 10 which can wind up the medium for recording M, as a roll R2, is provided on the downstream side of the recording head 4 in the transport direction A of the medium for recording M. In addition, in the embodiment, since the medium for recording M is wound so that the face for recording becomes the outer side, the winding shaft 10 rotates in the rotation direction C when winding up the medium for recording M. On the other hand, in a case in which the medium for recording is wound so that the face for recording is becomes the inner side, it is possible to wind up the medium for recording by performing a rotation which is reverse to the rotation direction C.

A tension bar 9 of which contact portion with the medium for recording M extends in the direction B, and which can apply a desired tension to the medium for recording M is provided between an end portion of the medium support unit 3 on the downstream side in the transport direction A of the medium for recording M and the winding shaft 10.

Subsequently, an electrical configuration in the recording apparatus 1 according to the embodiment will be described.

Figure 2:
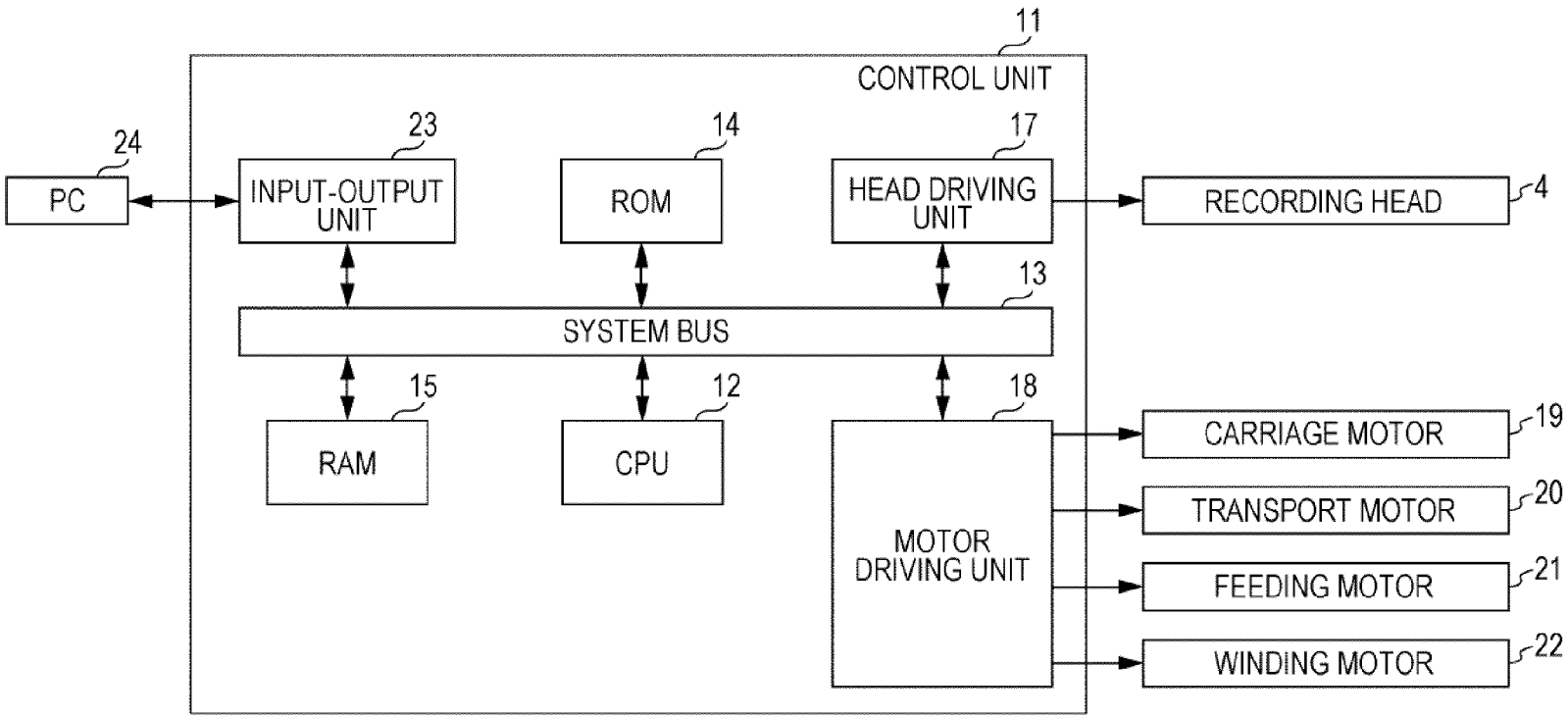
FIG. 2 is a block diagram of the recording apparatus according to the embodiment of the invention.

FIG. 2 is a block diagram of the recording apparatus 1 according to the embodiment.

A CPU 12 which entirely controls the recording apparatus 1 is provided in a control unit 11. The CPU 12 is connected to a ROM 14 which stores various programs, and the like, which are executed by the CPU 12, and a RAM 15 which temporarily stores data through a system bus 13.

The CPU 12 is connected to a head driving unit 17 which drives the recording head 4, through the system bus 13.

In addition, the CPU 12 is connected to a motor driving unit 18 which is connected to a carriage motor 19, a transport motor 20, a feeding motor 21, and a winding motor 22 through the system bus 13.

Here, the carriage motor 19 is a motor which moves the carriage 6 on which the recording head 4 is mounted in the direction B. The transport motor 20 is a motor which drives the driving roller 7 which configures the pair of transport rollers 5. The feeding motor 21 is a rotating mechanism of the supporting shaft 2, and is a motor which drives the supporting shaft 2 in order to feed the medium for recording M to the pair of transport rollers 5. In addition, the winding motor 22 is a driving motor which rotates the winding shaft 10.

The CPU 12 is connected to an input-output unit 23 which is connected to a PC 24 for performing transceiving of data such as recording data, and signals through the system bus 13.

The control unit 11 according to the embodiment can control the recording head 4 as the ejecting unit, the driving roller 7 as the transport roller which configures the transport unit, the carriage 6, and the like, using such a configuration.

In addition, it is a configuration in which it is possible to perform recording while alternately repeating transporting of the medium for recording M of a predetermined amount, and ejecting of ink while moving the recording head 4 in the direction B, when the control unit controls the recording head 4, the driving roller 7, the carriage 6, and the like.

Subsequently, the recording head 4 according to the embodiment will be described.

Figure 3:
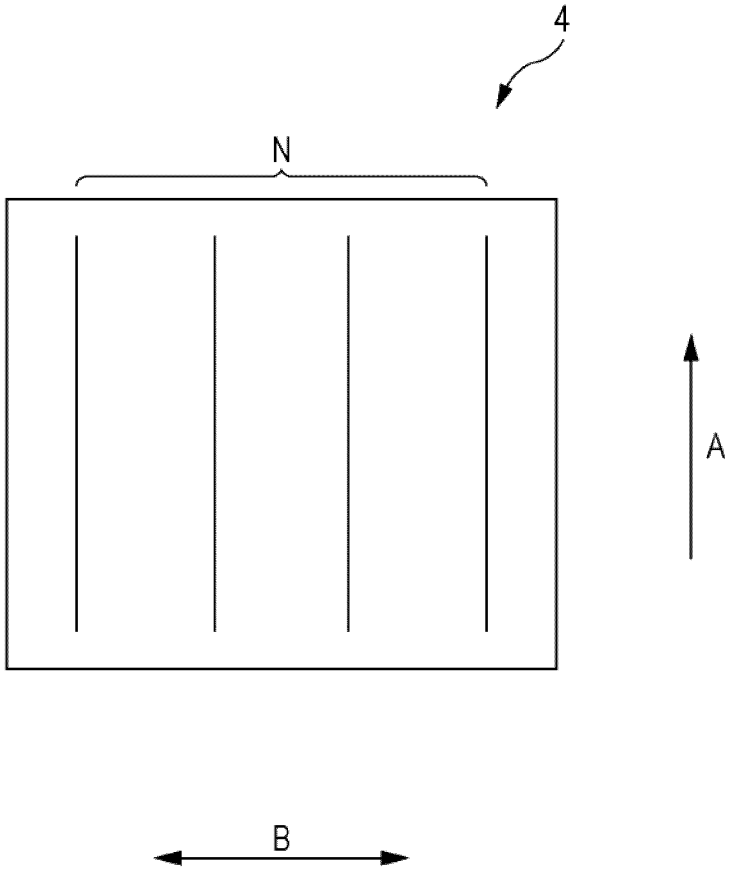
FIG. 3 is a schematic bottom view which illustrates a recording head of the recording apparatus according to the embodiment of the invention.

FIG. 3 is a bottom view of the recording head 4 according to the embodiment.

As illustrated in FIG. 3, the recording head 4 according to the embodiment includes a nozzle column N which ejects ink as an example of liquid. The nozzle column N has a configuration in which a plurality of nozzles are aligned along the transport direction A. In addition, the recording head 4 according to the embodiment is configured so as to reciprocate along with the carriage 6 in the direction B as the first direction which intersects the nozzle column N.

A direction which goes along the transport direction A intersecting the direction B as the first direction corresponds to a second direction.

As described above, the recording apparatus 1 according to the embodiment is provided with the recording head 4 which includes the nozzle column N, and can reciprocate in the first direction (direction B) which intersects the nozzle column N, and the pair of transport rollers 5 which transports the medium for recording M in the second direction (direction which goes along transport direction A) which intersects the first direction.

Figure 4:
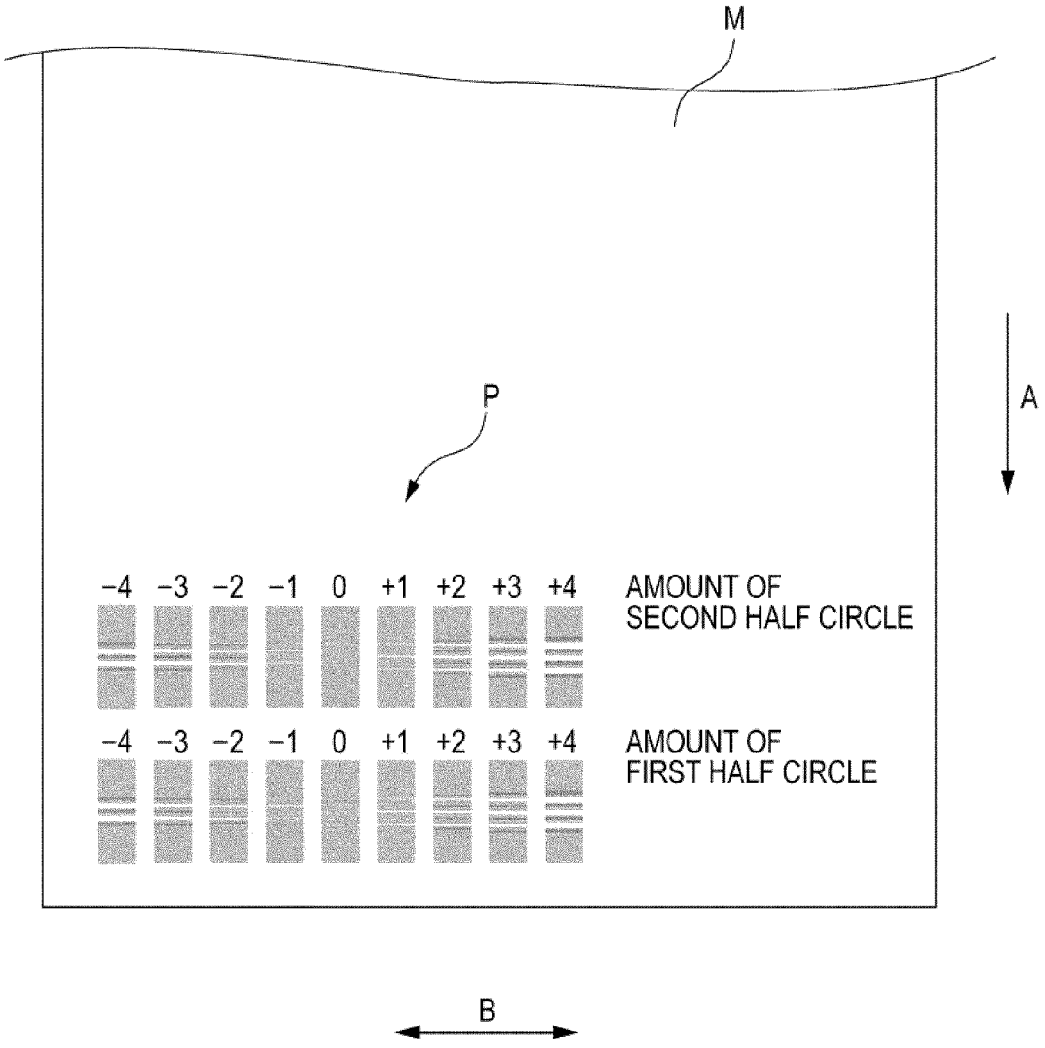
FIG. 4 is a schematic view which depicts an adjusting pattern of the recording apparatus according to the embodiment of the invention.
Figure 5B:
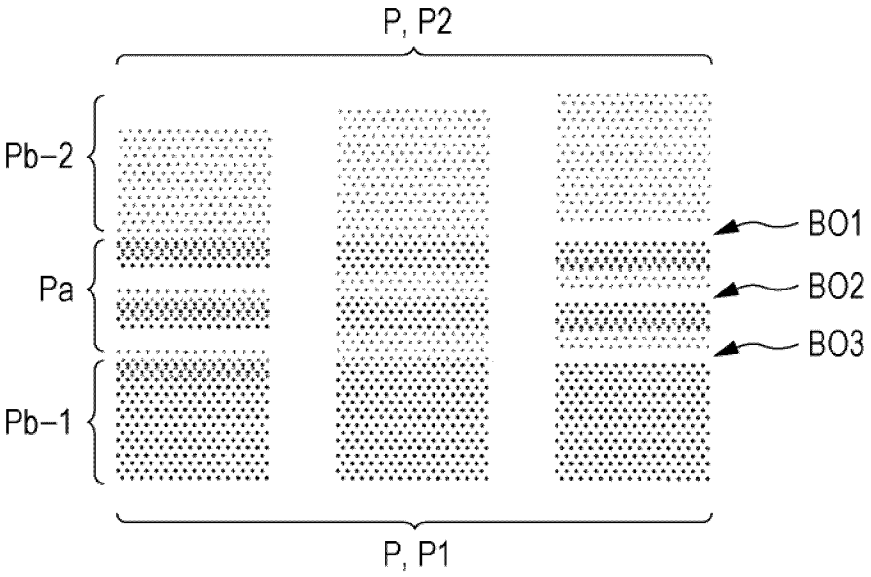
FIGS. 5A and 5B are schematic views which depict the adjusting pattern of the recording apparatus according to the embodiment of the invention.
Figure 5A:
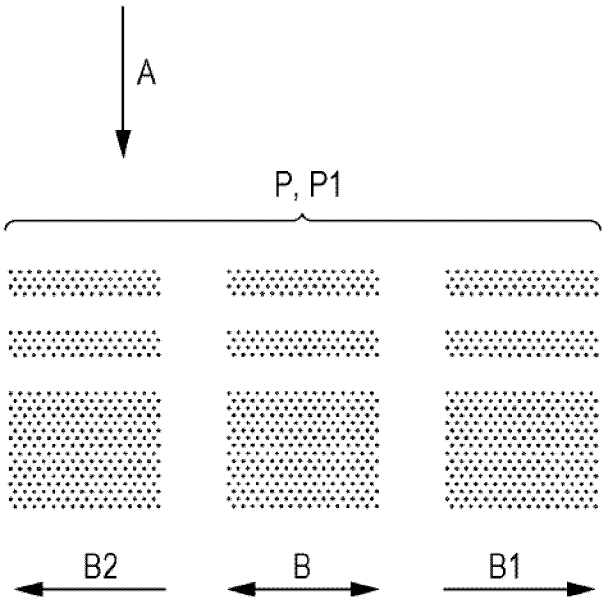

In addition, as shown in FIGS. 4 to 5B which will be described in detail later, the control unit 11 according to the embodiment can perform a control so that a first pattern P1 (refer to FIG. 5A) including a boundary region in which a plurality of boundary portions of an ejecting region and a non-ejecting region of ink are formed in the second direction is formed on the medium for recording M, by causing the ink to be ejected from the recording head 4, the medium for recording M on which the first pattern P1 is formed is transported by the pair of transport rollers 5, and a second pattern P2 (refer to FIG. 5B) including a boundary region in which a plurality of boundary portions are provided corresponding to the boundary region of the first pattern P1 is formed on the medium for recording M in the second direction, by causing the ink to be ejected from the recording head 4.

Here, the adjusting pattern P (refer to FIGS. 4 to 5B) of a transport amount of the medium for recording M which can be formed due to a control of the control unit 11 is an adjusting pattern which is formed by the first pattern P1 and the second pattern P2. In addition, it is an adjusting pattern in which boundaries BO (refer to FIG. 5B) between the first pattern P1 and the second pattern P2, which are formed of boundary portions of the first pattern P1 and the second pattern P2 which are formed by the boundary region of the first pattern P1 and the boundary region of the second pattern P2 are a plurality of adjusting patterns of boundaries BO1 to BO3 which are formed in the second direction. Here, in the following description, "boundary region in which plurality of boundary portions between ink ejecting region and non-ejecting region are formed in second direction" is denoted by a portion Pa (refer to FIG. 5B) in which the boundary portions BO are formed.

With such a configuration, the recording apparatus 1 according to the embodiment transports the medium for recording M after forming the first pattern P1, forms the second pattern P2 after transporting the medium for recording M, and can recognize a transport amount using the boundary BO between the first pattern P1 and the second pattern P2. In addition, since a transport amount of the medium for recording M is adjusted by forming the plurality of boundary portions BO of the boundary BO1 to the boundary BO3, it is possible to accurately adjust a transport amount of the medium for recording M even when an ejecting failure occurs in a nozzle which forms one boundary BO, if there is no ejecting failure in a nozzle which forms another boundary BO. For this reason, it is possible to prevent inaccurate adjustment of a transport amount of the medium for recording M, even in a case in which there is an ejecting failure in the recording head 4.

Subsequently, the adjusting pattern P of a transport amount of the medium for recording M will be described in detail.

FIGS. 4 to 5B are schematic views which describe the adjusting pattern P, in which FIG. 4 is a schematic view which illustrates the entire adjusting pattern P, and FIGS. 5A and 5B are schematic views which illustrate a part of the adjusting pattern P in detail.

Figure 7B:
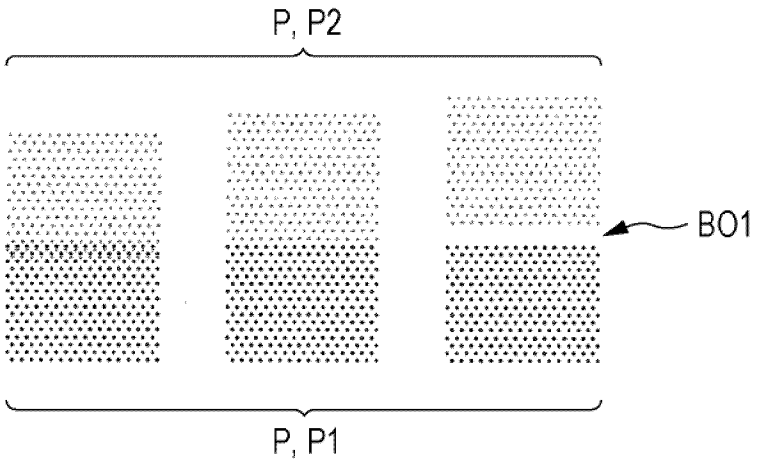
FIGS. 7A and 7B are schematic views which depict an adjusting pattern in a recording apparatus in the related art.
Figure 7A:
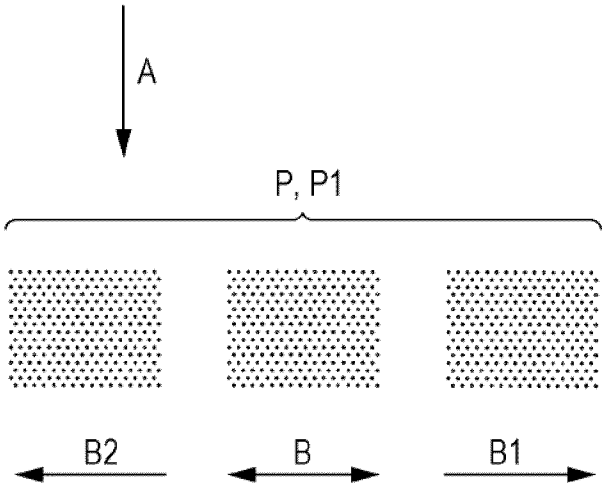

FIGS. 7A and 7B are schematic views which illustrate an adjusting pattern P in the related art, which is formed, using a recording apparatus 1 in the related art, and correspond to FIGS. 5A and 5B (FIG. 7A corresponds to FIG. 5A, and FIG. 7B corresponds to FIG. 5B).

As illustrated in FIGS. 5A and 5B, the adjusting patterns P for adjusting a transport amount of the medium for recording M in the embodiment includes a plurality of the first patterns P1 along the direction B (refer to FIG. 5A). The recording apparatus transports the medium for recording M, and forms a plurality of the second patterns P2 along the direction B by causing the second pattern to correspond to the first pattern P1, while shifting the second pattern P2 in the second direction with respect to the first pattern P1 (refer to FIG. 5B).

In addition, in FIGS. 5A and 5B, and FIGS. 7A and 7B, the first pattern P1 is denoted in a black color, and the second pattern P2 is denoted in a gray color.

In this manner, FIG. 4 illustrates a state in which the adjusting pattern P is continuously formed twice on the medium for recording M along the transport direction A (second direction). In detail, FIG. 4 illustrates a state in which a plurality of (9) adjusting patterns, which are formed in the direction B (first direction) by setting a position of the second pattern P2 with respect to the first pattern P1 to be moved in the second direction little by little, from the adjusting pattern P denoted by −4 to the adjusting pattern P denoted by +4, are continuously formed twice along the second direction.

The adjusting patterns P formed twice along the second direction in FIG. 4 respectively correspond to an adjusting pattern which is formed by a transport amount of approximately a half of a circumference with respect to a transport amount of one full circumference of the driving roller 7. In addition, it is possible to adjust a transport amount of the medium for recording M with good accuracy, in both of a first half circle and a second half circle of the driving roller 7, by adjusting a transport amount using an adjusting pattern P in the first half circle, and an adjusting pattern in the second half circle.

As illustrated in FIGS. 5A and 5B, both the first pattern P1 and the second pattern P2 in the embodiment are patterns which are formed by a plurality of dots, and patterns which include a portion in which dots are continuously formed in the first direction and the second direction (portion corresponding to comparison pattern Pb (comparison pattern Pb-1 in first pattern P1, and comparison pattern Pb-2 in second pattern P2)), and a portion in which dots are discontinuously formed in the second direction (boundary region Pa as region in which plurality of boundary portions between ink ejecting region and non-ejecting region are formed in second direction, in other words, portion Pa in which boundary BO is formed). In addition, the recording apparatus 1 according to the embodiment has a configuration in which it is possible to determine a desired transport amount using a method in which the portion Pa, in which the boundary BO is formed by both of the first pattern P1 and the second pattern P2, is formed on the medium for recording M (appearance), and to adjust an appropriate transport amount based on a determined result thereof.

When it is possible for both of the first pattern P1 and the second pattern P2 to form a plurality of boundaries BO between the first pattern P1 and the second pattern P2, there is no particular limitation in a pattern configuration thereof. Since it is possible for both of the first pattern P1 and the second pattern P2 to form the plurality of boundaries BO when having discontinuous patterns in the second direction, for example, it may be another pattern configuration which has discontinuous patterns in the second direction. In addition, for example, it may be a pattern configuration in which a plurality of boundaries BO are formed in a stepwise manner so that a position of each boundary BO is different in the second direction.

Specifically, it is possible to perform adjustment of a transport amount appropriately, when a user selects a position in which a stripe-shaped moire is most unnoticeable, visually, in the portion Pa in which the boundary BO is formed by both of the first pattern P1 and the second pattern P2, and input the position using an user interface (touch panel (not illustrated) provided in recording apparatus 1, or mouse or keyboard which is provided in PC 24) which is not illustrated.

The recording apparatus 1 according to the embodiment has a configuration in which a user visually selects a position in which moire is most unnoticeable, and input a value thereof, and in a case in which there are two positions in which moire is most unnoticeable, and it is difficult to make a determination, it may be a configuration in which a median value thereof can be input.

In FIG. 4, a position of "0" corresponds to a position in which a stripe-shaped moire is most unnoticeable in both of the first half circle and the second half circle. Therefore, the recording apparatus 1 according to the embodiment is configured so that, when a user inputs "0" using the user interface (not illustrated), or the like, adjustment of a transport amount corresponding to the "0" is performed. In addition, according to the embodiment, "0" is a default value. Here, for example, when "−1" is input, a transport amount is decreased from the default value by a distance of two nozzles which configure the nozzle column N, and are adjacent to each other, when "−2" is input, for example, a transport amount is decreased from the default value by a distance of three nozzles which configure the nozzle column N, and are continuous, when "−3" in input, for example, a transport amount is decreased from the default value by a distance of four nozzles which configure the nozzle column N, and are continuous, and when "−4" in input, for example, a transport amount is decreased from the default value by a distance of five nozzles which configure the nozzle column N, and are continuous. Meanwhile, when "+1" is input, a transport amount is increased from the default value by a distance of two nozzles which configure the nozzle column N, and are adjacent to each other, when "+2" is input, for example, a transport amount is increased from the default value by a distance of three nozzles which configure the nozzle column N, and are continuous, when "+3" in input, for example, a transport amount is increased from the default value by a distance of four nozzles which configure the nozzle column N, and are continuous, and when "+4" in input, for example, a transport amount is increased from the default value by a distance of five nozzles which configure the nozzle column N, and are continuous.

Here, as illustrated in FIGS. 5A and 5B, the adjusting pattern P in the embodiment is an adjusting pattern P in which the boundary BO between the first pattern P1 and the second pattern P2 is formed as the plurality of boundaries BO of the boundary BO1 to boundary BO3 in the second direction. For this reason, for example, it is possible to determine a desired transport amount using the boundary BO2 and the boundary BO3 in the portion Pa in which the boundary BO is formed, even when there is an ejecting failure in the nozzle which configures the boundary BO1 in the nozzle column N.

Meanwhile, as illustrated in FIGS. 7A and 7B, in an adjusting pattern in the related art, since there is only one boundary BO (boundary BO1) between the first pattern P1 and the second pattern P2 in the second direction, it is not possible to determine a desired transport amount, when there is an ejecting failure in a nozzle which configures the boundary BO1 in the nozzle column N.

In the above descriptions, the boundary BO is described as three boundaries BO1 to BO3, corresponding to the number of occurrences of stripe-shaped moire (the number of occurrences of so-called black stripe and white stripe) which extends in the direction B, and occurs in a case of not reaching a desired transport amount. However, it is also possible to describe that there are five boundaries BO, since there are five boundary portions between the ejecting region and the non-ejecting region when being counted along the transport direction A, in both of the first pattern P1 and the second pattern P2.

As described above, the adjusting pattern P according to the embodiment includes the comparison pattern Pb which can be compared with the boundary BO (in other words, portion Pa in which boundary BO is formed) in both of the first pattern P1 and the second pattern P2. For this reason, it is possible to simply recognize a position in which the stripe-shaped moire is most unnoticeable, and simply recognize an appropriate transport amount by referring to the comparison pattern Pb (compares portion Pa in which boundary BO is formed with comparison pattern Pb).

In addition, when the comparison pattern Pb which can be compared with the boundary BO is included in at least one of the first pattern P1 and the second pattern P2, it is possible to further simply recognize an appropriate transport amount by referring to the comparison pattern Pb. That is, it is possible to simply perform accurate adjustment of the transport amount.

The control unit 11 in the embodiment can perform a control so that the first pattern P1 and the second pattern P2 are formed on the medium for recording M along with a movement of the recording head 4 in the outward directions B1 or the return directions B2 in the first direction (direction B).

In general, there is a case in which spreading of a landing position of ink in a direction which extends along the nozzle column N becomes different in a case in which ink is ejected from the nozzle column N by moving the recording head 4 in the outward direction B1, than in a case in which ink is ejected from the nozzle column N by moving the recording head 4 in the return directions B2. Accordingly, it is possible to accurately adjust a transport amount in a case of forming the first pattern P1 and the second pattern P2 along with a movement of the ejecting unit in the outward directions B1 or the return directions B2, but not a case of forming the patterns P1, P2 using a combined movement of the recording head 4 in the outward direction B1 and the return direction B2. In the recording apparatus 1 according to the embodiment, since it is possible to form the first pattern P1 and the second pattern P2 along with a movement of the recording head 4 in the outward directions B1 or the return directions B2, it is possible to accurately perform adjustment of a transport amount, particularly.

In addition, correspondence between directions B1 and B2 in FIGS. 5A and 5B and the outward direction and return direction of the recording head 4 may be reversed.

The control unit 11 in the embodiment receives forming information of the boundary BO (information of position in which moire is most unnoticeable, which is determined by user, in the embodiment), and adjusts a transport amount of the medium for recording M using the pair of transport rollers 5, based on the forming information. For this reason, it is possible to accurately perform adjustment of a transport amount, using a simple method of inputting forming information of the boundary BO to the control unit 11.

Here, as "forming information of boundary BO", for example, there is information related to whether or not there is an occurrence of moire in the portion Pa in which the boundary BO is formed, or the like. In addition, "receiving forming information of boundary BO" is not limited to a situation in which a user determines a desired transport amount from a forming state of the boundary BO, inputs the desired transport amount using a user interface (not illustrated), or the like, and input contents thereof is received, as in the embodiment. For example, it may be a configuration in which a sensor for reading the boundary BO, or the like, is provided in the recording apparatus 1, the control unit 11 receives read data (for example, image density, or the like, of portion Pa in which boundary BO is formed) using the sensor, an appropriate transport amount is determined based on the read data, and a transport amount of the medium for recording M using the pair of transport rollers 5 is adjusted.

It is also possible for the control unit 11 according to the embodiment to perform a control so that the first pattern P1 and the second pattern P2 are formed on the medium for recording M along with a movement of the recording head 4 in the outward directions B1 and the return directions B2, receive forming information of each boundary BO which is formed on the medium for recording M along with a movement of the recording head 4 in outward directions B1 and return directions B2, and adjust a transport amount of the medium for recording M using the pair of transport rollers 5, based on each forming information. That is, it is possible to accurately perform adjustment of a transport amount, particularly, by forming adjusting patterns P of a transport amount which are formed of the first pattern P1 and the second pattern P2 along with a movement of the recording head 4 in the outward directions B1, and a movement of the recording head 4 in the return directions B2, and adjusting a transport amount based on each forming information of these adjusting patterns P.

In addition, "based on each forming information" in the embodiment is a method of obtaining an average of forming information of an adjusting pattern P which is formed along with a movement of the recording head 4 in the outward directions B1, and forming information of an adjusting pattern P which is formed along with a movement of the recording head 4 in the return directions B2. However, it is not limited to such a method, and it may be a method in which weighting is performed in each of forming information of adjusting patterns P of both, according to conditions of ejecting ink (for example, a case in which frequency of ejecting ink while moving recording head 4 in outward direction B1, and frequency of ejecting ink while moving recording head 4 in return direction B2 are different, or the like), or the like.

The pair of transport rollers 5 as the transport unit in the embodiment is provided with the driving roller 7 as the transport roller. In addition, as illustrated in FIG. 4, the control unit 11 performs a control so that the first pattern P1 and the second pattern P2 are formed two times on the medium for recording M, while setting a transport amount of the medium for recording M between forming of the first pattern P1 and forming of the second pattern P2 to a transport amount corresponding to a half of a circumference of the driving roller 7 (first half circle and second half circle). In other words, the recording apparatus 1 according to the embodiment forms the first patterns P1 and the second patterns P2 n times, while setting a transport amount of the medium for recording M between forming a first pair of the first and second patterns P1 and P2, and forming a second pair of the first and second patterns P1 and P2, to a transport amount corresponding to a rotation amount of 1/n of the driving roller 7 (n is integer). That is, an adjusting pattern P of a transport amount corresponding to one circle of the driving roller 7. For this reason, in a case in which the driving roller 7 is in an eccentric state, it is possible to perform adjustment of a transport amount, while suppressing an influence of the eccentric state.

In addition, "a rotation amount of 1/n of driving roller 7" means that it may be approximately a rotation amount of 1/n of the driving roller 7, and it is not necessary to be the rotation amount of 1/n of the driving roller 7 in a strict sense.

As illustrated in FIG. 5A, in the boundary region of the first pattern P1 (portion Pa in which boundary BO is formed) in the embodiment, the ejecting region and the non-ejecting region are alternately formed in the second direction (transport direction A). In addition, as illustrated in FIG. 5B, in the boundary region of the second pattern P2 in the embodiment, the non-ejecting region is formed corresponding to the ejecting region in the boundary region of the first pattern P1, and the ejecting region is formed corresponding to the non-ejecting region in the boundary region of the first pattern P1. That is, it is possible to determine a desired transport amount when the non-ejecting region in the boundary region of the second pattern P2 is disposed in the ejecting region in the boundary region of the first pattern P1 without being shifted in the second direction, and the ejecting region in the boundary region of the second pattern P2 is disposed in the non-ejecting region in the boundary region of the first pattern P1 without being shifted in the second direction. For this reason, it is possible to make a propriety determination (desired transport amount), visually, by a user, and to prevent inaccurate adjustment of a transport amount of the medium for recording M in a case in which there is an ejecting failure in the recording head 4, using such a simple pattern.

Subsequently, an embodiment of a transport amount adjusting method which is executed, using the recording apparatus 1 according to the embodiment will be described.

Figure 6:
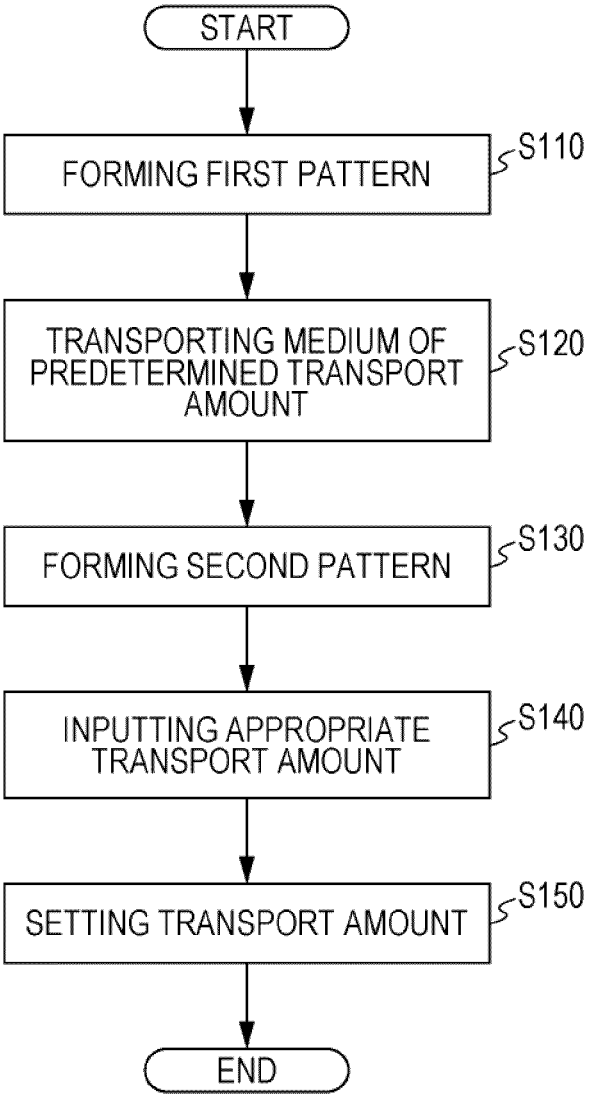
FIG. 6 is a flow chart which depicts an ejecting position adjusting method according to an embodiment of the invention.

FIG. 6 is a flowchart of the transport amount adjusting method in the embodiment.

When the a transport amount adjusting method in the embodiment is started, using an instruction, or the like, of a user, first, a discontinuous first pattern P1 is formed on the medium for recording M in the second direction, in step S110.

Subsequently, the medium for recording M is transported by a predetermined transport amount, in step S120.

Subsequently, a second pattern P2 which is discontinuous in the second direction is formed on the medium for recording M so that a plurality of boundaries BO between the first pattern P1 and the second pattern P2 in the second direction are formed, in step S130.

Subsequently, a user determines a position in which stripe-shaped moire is most unnoticeable, visually, and inputs an appropriate transport amount which is forming information of a boundary BO as a determination result thereof, using a user interface, or the like, in step S140.

Subsequently, the control unit 11 receives the input result in step S140 (forming information of boundary BO), and sets a transport amount based on the input result, in step S150.

In other words, the transport amount adjusting method in the embodiment is a method in which adjustment of a transport amount is performed, using the recording apparatus 1 which includes the recording head 4 including the nozzle column N which ejects ink, and can reciprocate in the first direction, and the pair of transport rollers 5 which transports the medium for recording M in the second direction. In addition, the method includes a first pattern forming process (step S110) in which the first pattern P1 including the boundary region in which the plurality of boundary portions between the ejecting region and the non-ejecting region of the ink are formed in the second direction (portion Pa in which dots are discontinuously formed in second direction), is formed on the medium for recording M, by causing the ink to be ejected from the recording head 4, a transport process (step S120) in which the medium for recording M on which the first pattern P1 is formed is transported by the pair of transport rollers 5, and a second pattern forming process (step S130) in which the second pattern P2 including the boundary region (portion Pa in which dots are discontinuously formed in second direction) in which the plurality of boundary portions are provided corresponding to the boundary region of the first pattern P1 in the second direction is formed on the medium for recording M, by causing the ink to be ejected from the recording head 4, in which the plurality of boundaries BO between the first pattern P1 and the second pattern P2 which are formed by the boundary portions of the first pattern P1 and the second pattern P2 which are formed by the boundary region of the first pattern P1 and the boundary region of the second pattern P2 are formed in the second direction.

By executing such a transport amount adjusting method, it is possible to prevent inaccurate adjustment of a transport amount of the medium for recording M, even in a case in which there is an ejecting failure in the recording head 4.

The invention is not limited to the above described embodiment, can be variously modified in the scope of the invention which is described in claims, and it is needless to say that these are also included in the scope of the invention.

What is claimed is:

1. A liquid ejecting apparatus comprising:

an ejecting unit that includes a nozzle column configured to eject liquid, the ejecting unit being configured to reciprocate along a first direction that intersects the nozzle column;

a transport unit configured to transport a medium in a second direction that intersects the first direction; and a control unit configured to control the ejecting unit and the transport unit such that:

a first pattern is formed on the medium by causing the liquid to be ejected from the ejecting unit, the first pattern including a boundary region in which a plurality of boundary portions between an ejecting region and a non-ejecting region of the liquid are formed in the second direction, the medium on which the first pattern is formed is transported by the transport unit, and a second pattern is formed on the medium by causing the liquid to be ejected from the ejecting unit, the second pattern including a boundary region in which a plurality of boundary portions between an ejecting region and a non-ejecting region of the liquid are formed in the second direction, the boundary region of the second pattern overlapping the boundary region of the first pattern, wherein each of the first and second patterns comprises a plurality of rows of dots, wherein each row of dots extends in the first direction, and wherein dots in adjacent rows are offset from one another in the first direction.

2. The liquid ejecting apparatus according to claim 1, wherein at least one of the first pattern and the second pattern includes a comparison pattern that does not include the boundary portions.

3. The liquid ejecting apparatus according to claim 1, wherein the control unit is configured to control the ejecting unit and the transport unit such that either (i) both the first pattern and the second pattern are formed on the medium along with movement of the ejecting unit in an outward direction along the first direction, or (ii) both the first pattern and the second pattern are formed on the medium along with movement of the ejecting unit in a return direction along the first direction.

4. The liquid ejecting apparatus according to claim 1, wherein the control unit is configured to receive forming information regarding the boundaries between the first pattern and the second pattern, and to adjust a transport amount of the medium using the transport unit, based on the forming information.

5. The liquid ejecting apparatus according to claim 1, wherein the control unit is configured to control the ejecting unit and the transport unit such that the first pattern and the second pattern are formed on the medium along with movement of the ejecting unit in an outward direction and a return direction, along the first direction, to receive forming information regarding the boundaries between the first pattern and the second pattern that are formed on the medium along with a movement of the ejecting unit in the outward direction and the return direction, and to adjust a transport amount of the medium using the transport unit based on the forming information.

6. The liquid ejecting apparatus according to claim 1, wherein the transport unit includes a transport roller, and wherein the control unit is configured to control the ejecting unit and the transport unit such that the first pattern and the second pattern are formed on the medium n times, and a transport amount of the medium between (i) forming a first pair of the first and second patterns, and (ii) forming a second pair of the first and second patterns, is set to an amount corresponding to a rotation amount of 1/n of a circumference of the transport roller.

7. The liquid ejecting apparatus according to claim 1, wherein the control unit is configured to control the ejecting unit and the transport unit such that:

the ejecting region and the non-ejecting region are alternately formed in the second direction in the boundary region of the first pattern, and in the boundary region of the second pattern, the non-ejecting region is formed corresponding to the ejecting region of the boundary region of the first pattern, and the ejecting region is formed corresponding to the non-ejecting region of the boundary region of the first pattern.

8. The liquid ejecting apparatus according to claim 1, wherein a width of each non-ejecting region in the second direction is greater than a width of a row of dots in the ejecting region in the second direction.

9. A transport amount adjusting method comprising:

providing a liquid ejecting apparatus comprising:

an ejecting unit that includes a nozzle column configured to eject liquid, the ejecting unit being configured to reciprocate along a first direction that intersects the nozzle column, and a transport unit configured to transport a medium in a second direction that intersects the first direction;

forming a first pattern on the medium by causing the liquid to be ejected from the ejecting unit, the first pattern including a boundary region in which a plurality of boundary portions between an ejecting region and a non-ejecting region of the liquid are formed in the second direction;

transporting the medium on which the first pattern is formed, using the transport unit; and forming a second pattern on the medium by causing the liquid to be ejected from the ejecting unit, the second pattern including a boundary region in which a plurality of boundary portions between an ejecting region and a non-ejecting region of the liquid are formed in the second direction, the boundary region of the second pattern overlapping the boundary region of the first pattern, wherein each of the first and second patterns comprises a plurality of rows of dots, wherein each row of dots extends in the first direction, and wherein dots in adjacent rows are offset from one another in the first direction.

* * * * *